US006776413B2

(12) United States Patent
Brown, III, deceased

(10) Patent No.: US 6,776,413 B2
(45) Date of Patent: Aug. 17, 2004

(54) TWO IN ONE DICE GAME

(75) Inventor: J. Breck Brown, III, deceased, late of Troy, MI (US), by R. Keith Stark, legal representative

(73) Assignee: Steven R. Pyykkonen, Leonard, MI (US)

( * ) Notice: Subject to any disclaimer, the term of this patent is extended or adjusted under 35 U.S.C. 154(b) by 0 days.

(21) Appl. No.: 10/345,549

(22) Filed: Jan. 16, 2003

(65) Prior Publication Data

US 2004/0140613 A1 Jul. 22, 2004

(51) Int. Cl.[7] ..... A63F 9/04
(52) U.S. Cl. ..... 273/146; 273/274; 273/292
(58) Field of Search ..... 273/146, 292, 273/274

(56) References Cited

U.S. PATENT DOCUMENTS

| | | | | | |
|---|---|---|---|---|---|
| 2,577,087 | A | * | 12/1951 | Meeks | 273/145 D |
| 4,921,249 | A | * | 5/1990 | Kropkowski et al. | 273/256 |
| 5,413,351 | A | * | 5/1995 | Franklin | 273/274 |
| 5,542,671 | A | * | 8/1996 | Stewart | 273/146 |
| 5,556,101 | A | * | 9/1996 | Jabro | 273/274 |
| 5,669,606 | A | | 9/1997 | Brown | 273/274 |
| 5,695,192 | A | | 12/1997 | Brown | 273/274 |
| 5,728,002 | A | * | 3/1998 | Hobert | 463/17 |
| 5,758,878 | A | | 6/1998 | Brown | 273/274 |
| 5,775,696 | A | * | 7/1998 | Sidlow et al. | 273/274 |
| 5,782,472 | A | | 7/1998 | Brown | 273/274 |
| 5,788,239 | A | | 8/1998 | Kong | 273/274 |
| 5,791,651 | A | * | 8/1998 | Bryant | 273/274 |
| 5,829,748 | A | * | 11/1998 | Moore, Jr. | 273/274 |
| 5,829,749 | A | * | 11/1998 | Hobert | 273/274 |
| 5,961,119 | A | * | 10/1999 | Brown | 273/292 |
| 5,964,463 | A | * | 10/1999 | Moore, Jr. | 273/274 |
| 6,019,373 | A | | 2/2000 | Brown | 273/292 |
| 6,213,876 | B1 | * | 4/2001 | Moore, Jr. | 463/22 |
| 6,336,633 | B1 | * | 1/2002 | Webb | 273/274 |
| 6,378,869 | B1 | * | 4/2002 | Hedge, Jr. et al. | 273/274 |
| 6,464,225 | B1 | * | 10/2002 | Webb | 273/274 |

OTHER PUBLICATIONS

Pub. No. US 2003/0075863—Friedman—Method of Playing Wagering Games—Apr. 24, 2003.*

* cited by examiner

*Primary Examiner*—Derris H. Banks
*Assistant Examiner*—Dolores R. Collins
(74) *Attorney, Agent, or Firm*—Howard & Howard

(57) ABSTRACT

A dice game based on craps numbers and using two dice among a plurality of players and a dealer. First, second and third craps propositions are based upon a first, second and third groups of dice numbers at first, second and third craps odds. High and low wager propositions are presented at even odds while an optional a tie wager propositions are presented at various predetermined tie odds for five pairs of dice numbers and the remaining sixth dice number. After the dice are rolled by the dealer to establish a house dice number, each player may place a craps wager on any one of the first, second and third craps propositions. Also, one of the players rolls the dice to establish a player dice number. After paying the high/low and tie wagers and all of the craps proposition wagers, the game ends, unless the dealer rolled either snake eyes or boxcars for the house dice number. In that case, the dealer rolls the dice again for a progressive pot qualifying number, e.g., another snake eyes or boxcars, in which case a player rolls the dice for the progressive pot to establish a progressive pot dice number. The progressive pot having the progressive pot dice number rolled by the player is paid out to the players in accordance with the odds therefore.

2 Claims, 2 Drawing Sheets

TWO IN ONE DICE GAME

BACKGROUND OF THE INVENTION

1. Field of the Invention

The invention relates to a dice game using two dice among a plurality of players and a dealer.

2. Description of the Prior Art

There are various games of dice and perhaps the best known is the game of craps. In craps each player rolls to match a dice numbered previously rolled by that player and the remaining players may make wagers on those rolls. The dice are passed from player to player.

The inventor herein has invented various games that employ wager propositions based upon craps dice numbers. These games are described in U.S. Pat. Nos. 5,669,606; 5,695,192; 5,758,878; 5,782,472; 5,961,119 and 6,019,373. Also known are dice games between the house and one or more players as disclosed in U.S. Pat. No. 5,556,101 to Jabro and U.S. Pat. No. 5,788,239 to Kong. The industry is always open to a new game and, particularly, one that relies totally on the roll of dice and includes multiple opportunities to win.

SUMMARY OF THE INVENTION

A dice game using two dice among a plurality of players and a dealer including establishing at least one wager proposition at predetermined odds for predetermined dice numbers, placing a wager on a wager proposition on behalf of each player, rolling the dice by the dealer to establish a house dice number, selecting one of the players to roll the dice and rolling the dice by that selected player to establish a player dice number, and paying each player having made a wager at the predetermined odds when the player dice number has a predetermined relationship to the house dice number.

Accordingly, the subject invention provides a game of dice wherein the players roll the dice against the house as represented by a dealer.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
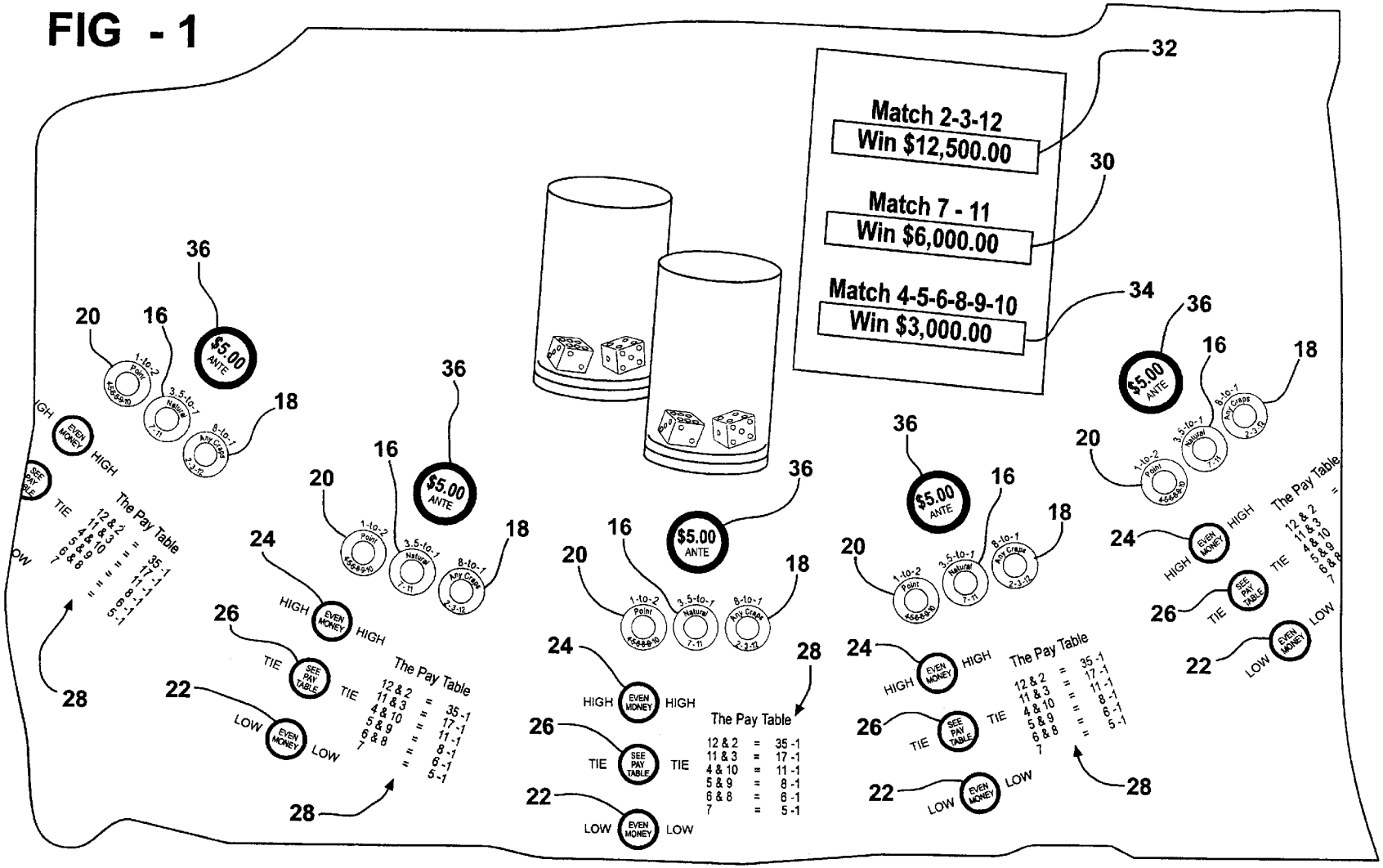
FIG. 1 is a view of a game board or computer monitor screen showing the components of the game assembly.

Referring to the Figure, an assembly is shown for playing a dice game based on craps numbers among a plurality of players and a dealer. Five player positions are shown with seven being preferable, but any number of players may be employed. The assembly comprises board, slot machine, electronic table, or the like.

Included in the assembly is a device 12 for rolling a pair of dice 14 having six faces numbered one to six by the dealer to establish a house dice number a by a player to establish a player dice number. This device may comprise one or more dice cups 12 as shown, or an electronic random generator for rolling the dice.

A first craps proposition 16 is presented for each player position and is based upon a first group of dice numbers at first craps odds, e.g., a first group of dice numbers including seven and eleven (7 and 11) at first craps odds of three and one half to one. A second craps proposition 18 is presented at each player position and is based upon a second group of dice numbers at second craps odds, e.g., a second group of dice numbers including two, three and twelve (2, 3 and 12) at second craps odds of eight to one. A third craps proposition 20 is presented and is based upon a third group of dice numbers at third craps odds, e.g., a third group of dice numbers including four, five, six, eight, nine and ten (4, 5, 6, 8, 9 and 10) at third craps odds of one to two.

Each player position is also presented a low wager proposition 22 at even odds and a high wager proposition 24 at even odds.

In addition, a tie wager proposition 26 is presented at predetermined odds for a predetermined dice number. More specifically, the predetermined odds for the tie wager is presented in a pay table 28: a tie wager proposition at first tie odds of thirty-five to one for a first pair of dice numbers of two and twelve (2 and 12), at second tie odds of eighteen to one for a second pair of dice numbers of three and eleven (3 and 11), at third tie odds of eleven to one for a third pair of dice numbers of four and ten (4 and 10), at fourth tie odds of seven to one for a fourth pair of dice numbers of five and nine (5 and 9), at fifth tie odds of five to one for a fifth pair of dice numbers of six and eight (6 and 8), and at sixth tie odds of four to one for the remaining sixth dice number of seven (7).

An odds maker 29 may be included in the case of a machine for paying each player the respective odds, or the dealer simply pays the winning players the respective odds.

The assembly also includes a first progressive pot 30 for the first group of dice numbers, a second progressive pot 32 for the second group of dice numbers, and a third progressive pot 34 for the third group of dice numbers.

Figure 2:
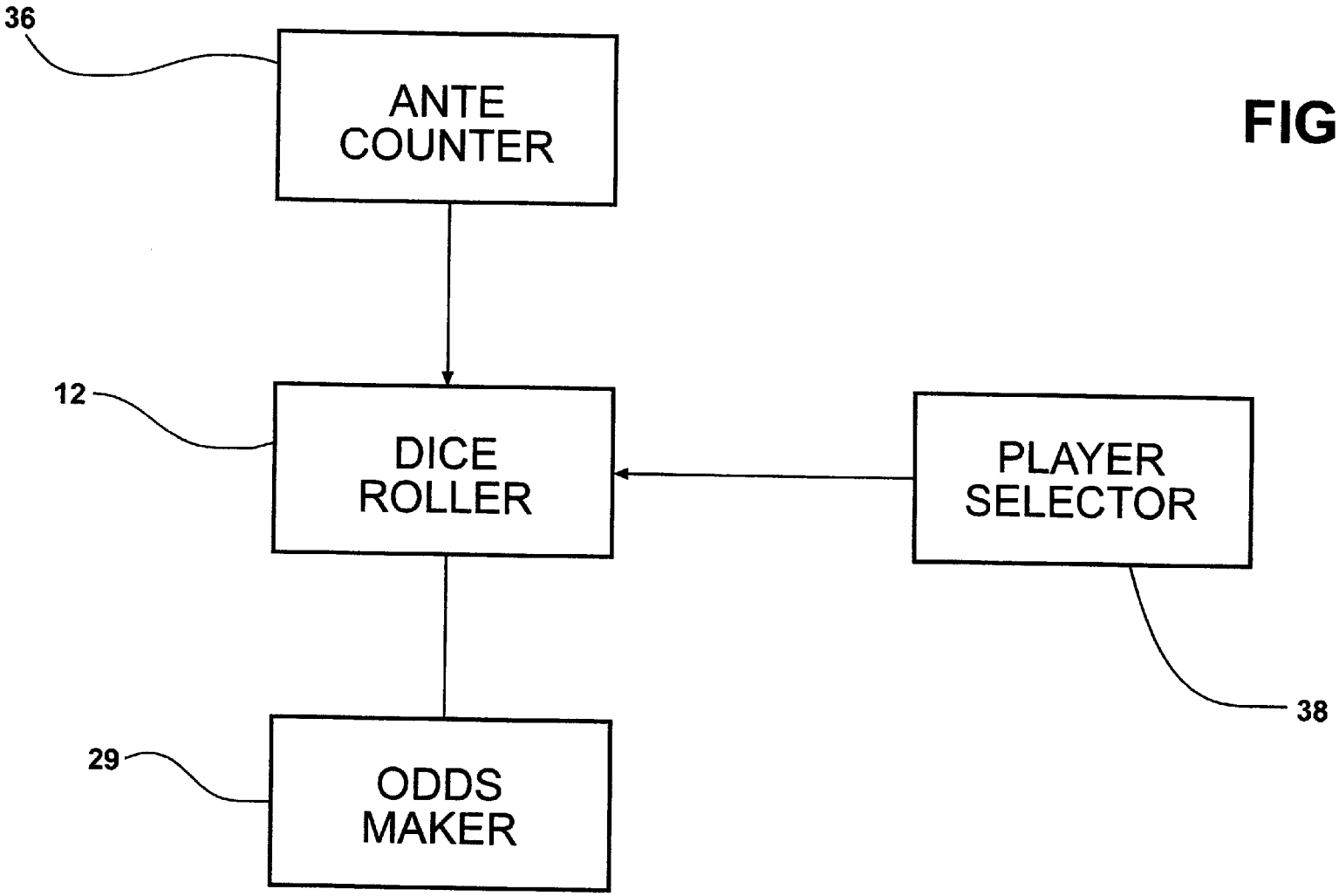
FIG. 2 is a block diagram of the components of the game assembly.

The method of playing the dice game begins by placing a progressive pot ante on behalf of each of the players at the ante position 36. The ante position may be simply that from which the dealer manually collects the ante or it may be an ante counter as shown in FIG. 2 to receive and count the antes. This wager is usually mandatory, i.e.; it is the price to play the game. This ante is divided by placing a portion of each ante into each of the progressive pots. Preferably, twenty five-percent of each ante is placed in each progressive pot 30, 32 and 34, with five percent being reserved as a small percentage of each ante for reseeding each of the progressive pots after being depleted by a win. The house receives the other twenty-five percent of each ante. The ante may be made on any one of the first, second and third progressive pots 30, 32 or 34.

In addition, each player must place an additional wager by placing a high/low wager on one of the high and low wager propositions or the optional tie wager on the tie wager proposition. In other words, each player must place a wager on one of the high or low wager propositions or on a tie wager instead on behalf of any player electing to do so.

The method includes the step of rolling the dice by the dealer to establish a house dice number. This is followed by providing the option to each player to place a craps wager on any one of the first 16, second 18 and third 20 craps propositions, i.e., after the dealer has rolled the dice for the house dice number.

Either the dealer selects or a random generator acts as a player selector 38 for selecting one of the players to roll the dice and the rolling of the dice by that selected player to establish a player dice number may be accomplished manually or electronically.

At this juncture, either the dealer or an electronic odds maker 29: pays each player having made a low wager even odds when the player dice number is below the house dice number and pays each player having made a high wager even odds when the player dice number is above the house dice number. Each player having made a high/low wager is allowed to retain the wager in the event the player number ties the house dice number except for a tie on the sixth dice number seven, in which case the player looses the wager to the house.

The dealer or odds maker 29 also pays each player having placed a tie wager at the first tie odds of thirty-five to one in the event the player number ties the house dice number at any one of the first pair of dice numbers of two and twelve (2 and 12), pays each player having placed a tie wager at the second tie odds of eighteen to one in the event the player number ties the house dice number at any one of the second pair of dice numbers of three and eleven (3 and 11), pays each player having placed a tie wager at the third tie odds of eleven to one in the event the player number ties the house dice number at any one of the third pair of dice numbers of four and ten (4 and 10), pays each player having placed a tie wager at the fourth tie odds of seven to one in the event the player number ties the house dice number at any one of the fourth pair of dice numbers of five and nine (5 and 9), pays each player having placed a tie wager at fifth tie odds of five to one in the event the player number ties the house dice number at any one of the fifth pair of dice numbers of six and eight (6 and 8), and pays each player having placed a tie wager at the sixth tie odds of four to one in the event the player number ties the house dice number at the sixth dice number of seven (7).

The settling of wagers continues by paying each player having made a craps wager on the first craps proposition at the first craps odds of three and one half to one in the event the player number matches anyone of the first group of dice numbers including seven and eleven (7 and 11), by paying each player having made a craps wager on the second craps proposition at the second craps odds of eight to one in the event the player number matches anyone of the second group of dice numbers including two, three and twelve (2, 3 and 12), and by paying each player having made a craps wager on the third craps proposition at the third craps odds of one to two in the event the player number matches anyone of the third group of dice numbers including four, five, six, eight, nine and ten (4, 5, 6, 8, 9 and 10).

The game continues by rolling the dice by the dealer for a progressive pot qualifying number in the event the house dice number equals anyone of the first pair of dice numbers of two and twelve (2 and 12). In other words, the play for one of the progressive pots only occurs in the event the first time the dealer rolls the dice, the roll produces a two (2, snake eyes) or a twelve (12, boxcars). The dealer then rolls the dice again to roll a progressive pot qualifying number which ties the house dice number, i.e., to match the two (2, snake eyes) or a twelve (12, boxcars) originally rolled. In that event, the game proceeds by either the dealer or the player selector 38 selecting a player to roll the dice for the progressive pot. The selected player rolls the dice for the progressive pot to establish a progressive pot dice number. The dealer or the odds maker 29 divides the first progressive pot 30 among the players in the event the progressive pot dice number ties any one of the first group of dice numbers seven and eleven (7 and 11), divides the second progressive pot 32 among the players in the event the progressive pot dice number ties any one of the second group of dice numbers including two, three and twelve (2,3 and 12), and divides the third progressive pot 34 among the players in the event the progressive pot dice number ties any one of the third group of dice numbers including four, five, six, eight, nine and ten (4,5,6,8,9 and 10). Ass alluded to above, the five percent reserved in each ante re-seeds the progressive pot to which the successive antes are added so long as the dealer does not initially roll a two (2, snake eyes) or a twelve (12, boxcars).

Obviously, many modifications and variations of the present invention are possible in light of the above teachings. The invention may be practiced otherwise than as specifically described within the scope of the appended claims.

What is claimed is:

1. A method of playing a dice game based on craps numbers and using two dice among a plurality of players and a dealer, said method comprising the steps of:

providing a pair of dice having six faces numbered one to six;

establishing a first craps proposition based upon a first group of dice numbers at first craps odds;

establishing a second craps proposition based upon a second group of dice numbers at second craps odds;

establishing a third craps proposition based upon a third group of dice numbers at third craps odds;

establishing a low wager proposition at even odds;

establishing a high wager proposition at even odds;

establishing a tie wager proposition at first tie odds for a first pair of dice numbers; at second tie odds for a second pair of dice numbers, at third tie odds for a third pair of dice numbers, at fourth tie odds for a fourth pair of dice numbers, at fifth tie odds for a fifth pair of dice number, and at sixth tie odds for the remaining sixth dice number, placing a high/low wager on one of the high and low wager propositions on behalf of each player;

placing an optional tie wager on the tie wager proposition on behalf of any player electing to do so;

rolling the dice by the dealer to establish a house dice number;

providing the option to each player to place a craps wager on any one of the first, second and third craps propositions after the dealer has rolled the dice for the house dice number, selecting one of the players to roll the dice and rolling the dice by that selected player to establish a player dice number;

paying each player having made a low wager even odds when the player dice number is below the house dice number;

paying each player having made a high wager even odds when the player dice number is above the house dice number;

allowing each player having made a high/low wager to retain the wager in the event the player number ties the house dice number except for a tie on the sixth dice number, in which case the player looses the wager;

paying each player having placed a tie wager at the first tie odds in the event the player number ties the house dice number at any one of the first pair of dice numbers;

paying each player having placed a tie wager at the second tie odds in the event the player number ties the house dice number at any one of the second pair of dice numbers;

paying each player having a tie wager at the third tie odds in the event the player number ties the house dice number at any one of the third pair of dice numbers, paying each player having placed a tie wager at the fourth tie odds in the event the player number ties the house dice number at any one of the fourth pair of dice numbers;

paying each player having placed a tie wager at the fifth tie odds in the event the player number ties the house dice number at any one of the fifth pair of dice numbers;

paying each player having placed a tie wager at the sixth tie odds in the event the player number ties the house dice number at the sixth dice number;

paying each player having made a craps wager on the first craps proposition at the first craps odds in the event the player number matches anyone of the first group of dice numbers;

paying each player having made a craps wager on the second craps proposition at the second craps odds in the event the player number matches anyone of the second group of dice numbers;

paying each player having made a craps wager on the third craps proposition at the third craps odds in the event the player number matches anyone of the third group of dice numbers;

establishing a first progressive pot for the first group of dice numbers;

establishing a second progressive pot for the second group of dice numbers;

establishing a third progressive pot for the third group of dice numbers;

placing a progressive pot ante on behalf of each of the players;

placing a portion of each ante into each of the progressive pots;

rolling the dice by the dealer for a progressive pot qualifying number in the event of the house dice number equals anyone of the first pair of dice numbers;

selecting a player to roll the dice for the progressive pot in the event the progressive pot qualifying number ties the house dice number;

rolling the dice by the player selected to roll for the progressive pot to establish a progressive pot dice number;

dividing the first progressive pot among the players in the event the progressive pot dice number ties any one of the first group of dice;

dividing the second progressive pot among the players in the event the progressive pot dice number ties any one of the second group of dice numbers; and dividing the third progressive pot among the players in the event the progressive pot dice number ties any one of the third group of dice numbers.

2. A method of playing a dice game based on craps numbers and using two dice among a plurality of players and a dealer, said method comprising the steps of:

providing a pair of dice having six faces numbered one to six;

establishing a first craps proposition based upon a first group of dice numbers including seven and eleven (7 and 11) at first craps odds of three and one half to one;

establishing a second craps proposition based upon a second group of dice numbers including two, three and twelve (2, 3 and 12) at second craps odds of eight to one;

establishing a third craps proposition based upon a third group of dice numbers including four, five, six, eight, nine and ten (4, 5, 6, 8, 9 and 10) at third craps odds of one to two;

establishing a low wager proposition at even odds;

establishing a high wager proposition at even odds;

establishing a tie wager proposition at first tie odds of thirty-five to one for a first pair of dice numbers of two and twelve (2 and 12), at second tie odds of eighteen to one for a second pair of dice numbers of three and eleven (3 and 11), at third tie odds of eleven to one for a third pair of dice numbers of four and ten (4 and 10), at fourth tie odds of seven to one for a fourth pair of dice numbers of five and nine (5 and 9), at fifth tie odds of five to one for a fifth pair of dice numbers of six and eight (6 and 8), and at sixth tie odds of four to one for the remaining sixth dice number of seven (7);

establishing a first progressive pot for the first group of dice numbers;

establishing a second progressive pot for the second group of dice numbers;

establishing a third progressive pot for the third group of dice numbers;

placing a progressive pot ante on behalf of each of the players;

placing a portion of each ante into each of the progressive pots;

reserving a small percentage of each ante for reseeding each of the progressive pots;

placing a high/low wager on one of the high and low wager propositions on behalf of each player;

placing an optional tie wager on the tie wager proposition on behalf of any player electing to do so;

rolling the dice by the dealer to establish a house dice number;

providing the option to each player to place a craps wager on any one of the first, second and third craps propositions after the dealer has rolled the dice for the house dice number, selecting one of the players to roll the dice and rolling the dice by that selected player to establish a player dice number;

paying each player having made a low wager even odds when the player dice number is below the house dice number;

paying each player having made a high wager even odds when the player dice number is above the house dice number;

allowing each player having made a high/low wager to retain the wager in the event the player number ties the house dice number except for a tie on the sixth dice number seven, in which case the player looses the wager;

paying each player having placed a tie wager at the first tie odds of thirty-five to one in the event the player number ties the house dice number at any one of the first pair of dice numbers of two and twelve (2 and 12);

paying each player having placed a tie wager at the second tie odds of eighteen to one in the event the player number ties the house dice number at any one of the second pair of dice numbers of three and eleven (3 and 11);

paying each player having placed a tie wager at the third tie odds of eleven to one in the event the player number ties the house dice number at any one of the third pair of dice numbers of four and ten (4 and 10), paying each player having placed a tie wager at the fourth tie odds of seven to one in the event the player number ties the house dice number at any one of the fourth pair of dice numbers of five and nine (5 and 9);

paying each player having placed a tie wager at fifth tie odds of five to one in the event the player number ties the house dice number at any one of the fifth pair of dice numbers of six and eight (6 and 8);

paying each player having placed a tie wager at the sixth tie odds of four to one in the event the player number ties the house dice number at the sixth dice number of seven (7);

paying each player having made a craps wager on the first craps proposition at the first craps odds of three and one half to one in the event the player number matches anyone of the first group of dice numbers including seven and eleven (7 and 11);

paying each player having made a craps wager on the second craps proposition at the second craps odds of eight to one in the event the player number matches anyone of the second group of dice numbers including two, three and twelve (2,3 and 12);

paying each player having made a craps wager on the third craps proposition at the third craps odds of one to two in the event the player number matches anyone of the third group of dice numbers including four, five, six, eight, nine and ten (4, 5, 6, 8, 9 and 10);

rolling the dice by the dealer for a progressive pot qualifying number in the event the house dice number equals anyone of the first pair of dice numbers of two and twelve (2 and 12);

selecting a player to roll the dice for the progressive pot in the event the progressive pot qualifying number ties the house dice number;

rolling the dice by the player selected to roll for the progressive pot to establish a progressive pot dice number;

dividing the first progressive pot among the players in the event the progressive pot dice number ties any one of the first group of dice numbers seven and eleven (7 and 11);

dividing the second progressive pot among the players in the event the progressive pot dice number ties any one of the second group of dice numbers including two, three and twelve (2,3 and 12); and dividing the third progressive pot among the players in the event the progressive pot dice number ties any one of the third group of dice numbers including four, five, six, eight, nine and ten (4,5,6,8,9 and 10).

* * * * *